United States Patent [19]

Dobkin

[11] Patent Number: 4,792,745

[45] Date of Patent: Dec. 20, 1988

[54] DUAL TRANSISTOR OUTPUT STAGE

[75] Inventor: Robert C. Dobkin, San Jose, Calif.

[73] Assignee: Linear Technology Corporation, Milpitas, Calif.

[21] Appl. No.: 114,439

[22] Filed: Oct. 28, 1987

[51] Int. Cl.[4] ..... G05F 1/46

[52] U.S. Cl. ..... 323/269; 323/274; 323/350

[58] Field of Search ..... 323/268, 269, 273, 274, 323/275, 279, 349, 350; 330/252, 260, 297

[56] References Cited

U.S. PATENT DOCUMENTS

| | | | |
|---|---|---|---|
| 3,704,381 | 11/1972 | Nercessian | 323/268 |
| 4,189,670 | 2/1980 | Tanahashi | 323/268 |
| 4,456,833 | 6/1984 | Traub et al. | 323/268 |
| 4,644,247 | 2/1987 | Burmenko | 323/269 |

*Primary Examiner*—Peter S. Wong

*Attorney, Agent, or Firm*—Laurence S. Rogers; Mark D. Rowland

[57] ABSTRACT

A circuit is provided for distributing load current among multiple power transistors in an output stage, each power transistor being adapted to conduct current over a different range of collector-emitter voltages. The circuit includes a first power transistor having a large ballast resistance for conducting current between the input and output of the circuit when the input/output voltage differential is high, and a second power transistor having a small ballast resistance for conducting current between the input and output of the circuit when the input/output voltage differential is low. Both transistors respond to a single control signal, and buffering is provided to prevent either transistor from overloading the common control point. Individual current limit protection circuitry is provided for each transistor, including a foldback network which reduces the current limit value of the current limit circuitry when the input/output voltage differential reaches a threshold value.

9 Claims, 2 Drawing Sheets

DUAL TRANSISTOR OUTPUT STAGE

BACKGROUND OF THE INVENTION

The present invention relates to an output stage for a voltage regulator or other type of circuit which must conduct load current at both low and high input/output voltage differentials. More particularly, the present invention relates to a circuit for distributing load current among multiple power transistors, each optimized to conduct current over a different range of input/output voltage differentials.

Power devices, such as voltage regulators and power switches, which often must supply current to a load while operating at a high input/output voltage differential, require an output stage power transistor that can conduct substantial load current at such high voltage differentials without creating a risk of destroying the power transistor due to thermal instabilities and overheating in localized areas of the transistor. To prevent the power transistor from becoming damaged in this fashion, ballast resistors are used in the emitter of the power transistor to stabilize the current in the transistor.

Ballast resistance increases the voltage dropped across the emitter of the transistor in proportion to the current conducted by the transistor. In certain circumstances, this increase in voltage may increase the minimum operating voltage of a power device. An adequately ballasted power transistor, for example, should have sufficient ballast resistance to drop approximately 100–500 mV when conducting a low current at high input/output voltage differentials. Under such conditions, the increased voltage drop across the transistor caused by the ballast resistance does not significantly degrade the performance of the power device because the input/output voltage differential at which the device is operating will generally exceed the voltage drop across the power transistor. At higher currents and lower voltage differentials, however, the ballast resistance can place undesirable limits on the power device. Having a resistance in the emitter of the transistor increases the minimum value of the saturation voltage of the transistor. At high currents the voltage drop across the ballast resistance alone may be between 200 mV and 2V, thus causing a great increase in the minimum operating voltage for the power transistor and the power device in which the transistor is employed.

For this reason, a power transistor having a low ballast resistance is desirable in the output stage of power devices which conduct high currents while operating at low input/output voltage differentials. However, such a power transistor is unstable at high input/output voltage differentials, and thus if used alone as an output stage would severely limit the operating range of the power device.

In view of the foregoing, it would be desirable to be able to provide an output stage for a power device such as a voltage regulator or a power switch that has both a low minimum operating voltage and the ability to conduct substantial load current safely at high input/output voltage dif- ferentials.

SUMMARY OF THE INVENTION

It is therefore an object of the present invention to provide an output stage for a power device such as a voltage regulator or a power switch that has both a low minimum operating voltage and the ability to conduct substantial load current safely at high input/output voltage differentials.

This and other objects and advantages of the present invention are accomplished by a circuit in which a first power transistor having a large ballast resistance is employed to conduct current between the input and output of the circuit when the input/output voltage differential is high, and in which a second power transistor having a small ballast resistance is employed to conduct current when the voltage differential is low. Both transistors respond to a single control signal, and buffering is provided to prevent either transistor from overloading the common control point. Individual current limit protection circuitry is provided for each transistor, including a foldback network which reduces the current limit value of the current limit circuitry when the input/output voltage differential reaches a threshold voltage.

BRIEF DESCRIPTION OF THE DRAWINGS

The above and other objects and advantages of the present invention will be apparent upon consideration of the following detailed description, taken in conjunction with the accompanying drawings, in which.

DETAILED DESCRIPTION OF THE INVENTION

Figure 1:
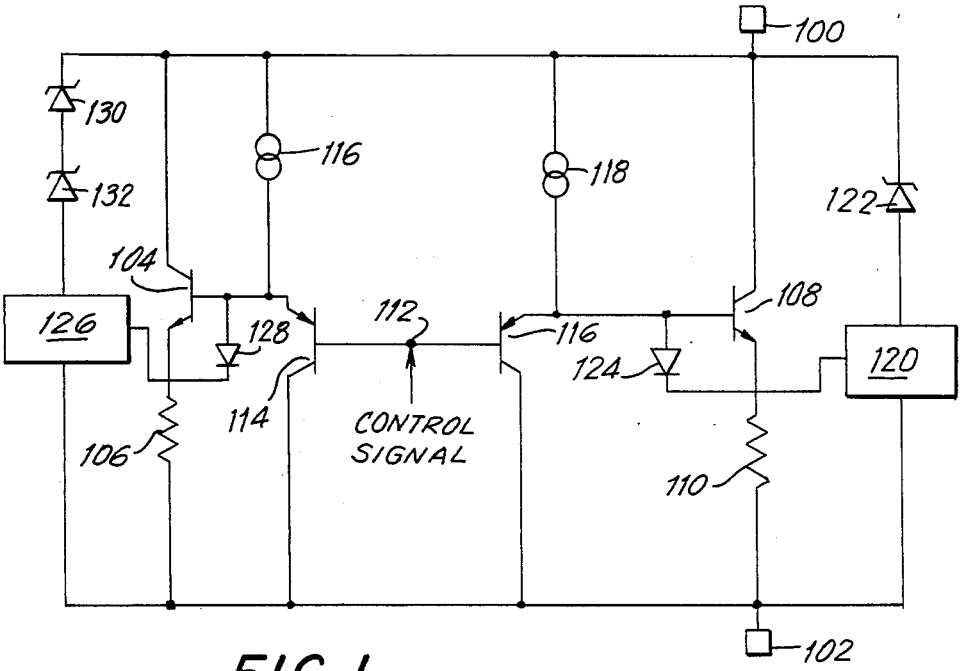
FIG. 1 is a simplified schematic diagram of a circuit illustrating the principles of the present invention.

Referring to FIG. 1, a simplified diagram of a circuit having a low saturation voltage and the ability to conduct current between its input and output at a high input/output voltage differential is shown. The circuit is adapted to be connected to a power supply at input terminal 100, and to a load at output terminal 102. Transistor 104 is a power transistor having a large ballast resistance 106. Transistor 108 is a power transistor having a small ballast resistance 110. Transistors 104 and 106 are both controlled by a single control signal applied to control point 112 at the common bases of transistors 114 and 116.

At a low input/output voltage differential, current is conducted between input terminal 100 and output terminal 102 by transistor 108 when the voltage at control point 112 is driven high by a control signal applied thereto. The control signal applied to control point 112 decreases the current conducted by transistor 116, such that current conducted by current source 118 drives transistor 108. The control signal also decreases the current conducted by transistor 114. However, the large ballast resistance 106 of transistor 104 limits the current conducted by transistor 104 at low input/output voltage differentials. Transistor 104 is driven into saturation as a result of its large ballast resistance and is unable to conduct any significant amount of current at low input/output voltage differentials. Thus, at low input/output voltage differentials, where a large ballast resistance is not required, substantially all of the load current bypasses the large ballast resistance of transistor 104, and is conducted by transistor 108 and its low ballast resistance 110.

The saturation of transistor 104 does not significantly increase the load on control point 112, due to the buffering action of transistor 114. As transistor 104 saturates, transistor 114 receives less operating current from current source 116 and only a small change in load at control point 112 occurs.

As the input/output voltage differential increases, current limit circuit 120, which senses the input/output voltage differential, limits conduction of transistor 108 when the voltage differential exceeds a certain threshold voltage. The threshold voltage is referenced to the breakdown voltage of zener diode 122. Current limit is accomplished by shunting the base drive for transistor 108 through diode 124 to terminal 102. Due to the buffering action of transistor 116, limiting conduction of transistor 108 does not significantly affect the loading on control point 112.

By limiting conduction of transistor 108 as the input/output voltage differential increases, damage to transistor 108 is avoided. Current conduction to a load connected to terminal 102 continues at such increased input/output voltage differential because substantially all of the load current now is conducted by transistor 104. Transistor 104 is able to operate safely at high voltage differentials because of its large ballast resistance 106. As the voltage differential or current continues to increase, a power level may be reached at which transistor 104, even with its large ballast resistor 106, becomes unstable. To prevent such instability, current limit circuit 126 senses the input/output voltage differential, and shunts base drive current away from transistor 104 through diode 128 when a predetermined threshold voltage is reached. The threshold voltage of current limit circuit 126 is referenced to the combined breakdown voltages of zener diodes 130 and 132, such that the threshold voltage set by current limit circuit 126 is higher than that of current limit circuit 122.

The circuit described above illustrates how, in accordance with the principles of the present invention, load current is distributed among power transistors which are responsive to a common control signal and are optimized to conduct the load current over different ranges of input/output voltage differentials. Although the circuit has been described with only two power transistors, it is of course to be appreciated that more complex optimizing schemes can be achieved in accordance with the principles of the present invention by using several power transistors having various amounts of ballast resistance, and by biasing the transistors to operate over contiguous narrow ranges of input/output voltage differentials.

Also, it will be appreciated, after consideration of the circuit shown in FIG. 2 and the accompanying text below, that other methods may be used to vary the distribution of load current among the individual power transistors as the input/output voltage differential changes. For example, a transistor optimized to conduct load current at high input/output voltage differentials may be prevented from conducting current at low voltage differentials by its ballast resistance, as shown in FIG. 1, or by other limiting circuits such as that described below. On the other hand, it is of course to be appreciated by those of skill in the art that such a transistor need not be prevented from conducting current at low voltage differentials, such that load current at low voltage differentials is conducted simultaneously by a transistor optimized to conduct current at low voltage differentials and a transistor optimized to conduct current at high voltage differentials, particularly if the current conducted by the latter is small.

Figure 2:
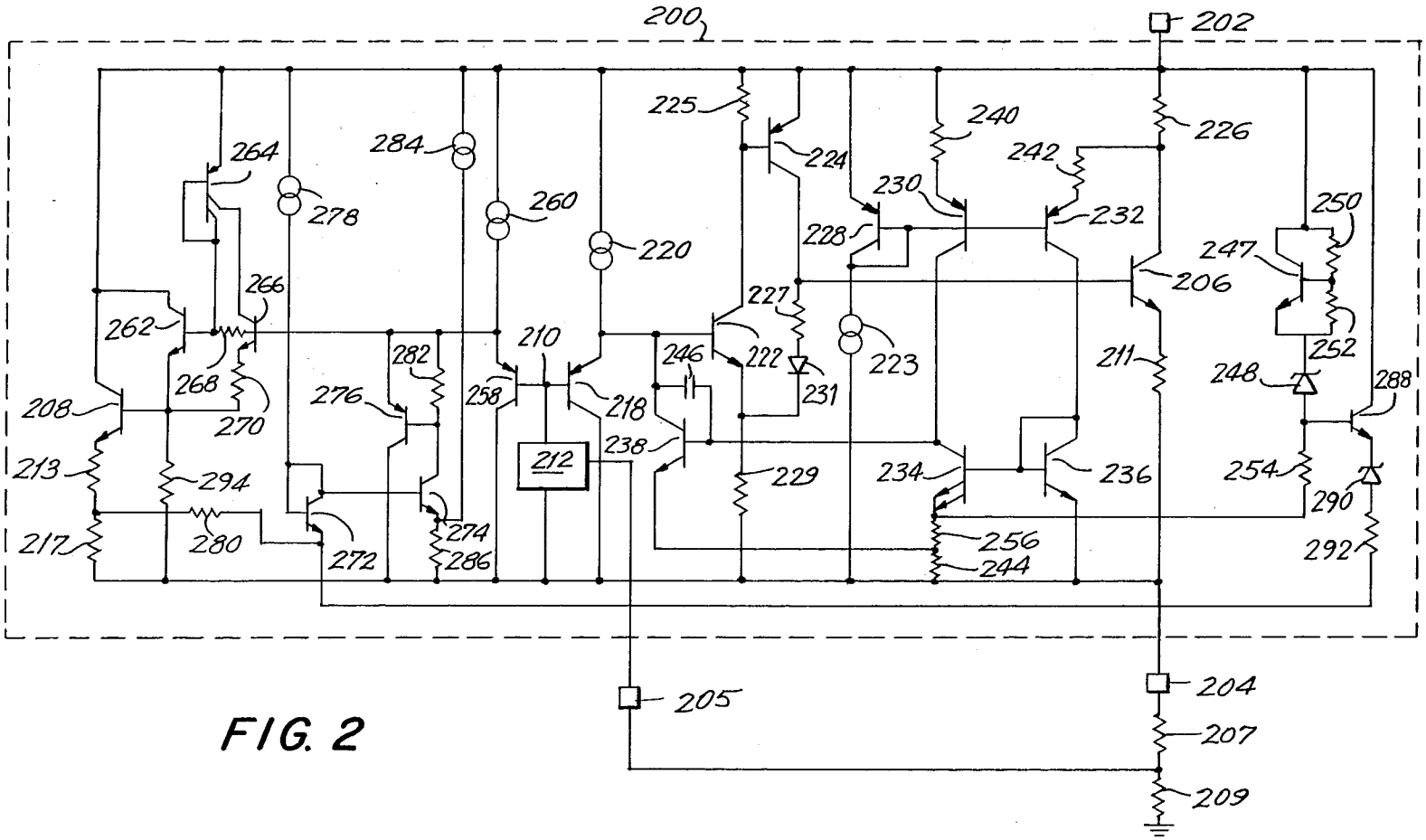
FIG. 2 is a schematic diagram of a voltage regulator circuit incorporating the present invention.

A 3-terminal low dropout voltage regulator circuit 200 incorporating an embodiment of the present invention is shown in FIG. 2. Load current is conducted between input terminal 202 and output terminal 204 by power transistors 206 and 208 in response to a control signal applied to control point 210 by control circuit 212. Control circuit 212 is a conventional Brokaw cell voltage reference and error amplifier circuit. Other well-known band-gap voltage reference circuits also may be used. Control circuit 212 is connected in a conventional way to output terminal 204 and adjust terminal 205, to which terminals external resistors 207 and 209 are also connected. Control circuit 212 develops a reference voltage between output terminal 204 and adjust terminal 205 and, as described below, controls the voltage of control point 210 and the current conducted by transistors 206 and 208 to maintain the voltage across external resistor 207 at the reference voltage.

Power transistors 206 and 208 are conventionally structured, each comprising a number of sections connected in parallel. Each section is made up of an individual base region with a number of individually ballasted emitter stripes. Resistors 211 and 213 respectively represent the ballast resistors for the individual emitter stripes of transistors 206 and 208. The sections of transistor 208 are also individually ballasted. Resistor 217 represents the ballast resistors for the sections of transistor 208. Typically, the total ballast resistance of transistor 206 is much smaller than that of transistor 208. For instance, in the preferred embodiment transistor 206 comprises 112 individual emitter stripes grouped into four sections of 28 stripes. Each stripe has a ballast resistor of approximately 1.1 ohms. The secions are not ballasted. Transistor 208 comprises 60 individual emitter stripes grouped into two sections of 30 stripes. Each stripe has a ballast resistor of approximately 50 ohms. Each section is also ballasted by two resistors of approximately 1.7 ohms. Preferred values for the ballast resistors and other components shown in FIG. 2 are listed in the table below.

At low input/output voltage differentials, current is conducted between input terminal 202 and output terminal 204 by transistor 206 in response to a control signal applied to control point 210 by control circuit 212, as follows. When the base of transistor 218 is driven to a voltage near the voltage at output terminal 204, transistor 218 turn on and conducts current supplied by current source 220. The voltage at the emitter of transistor 218, which is approximately one diode drop above the voltage at output terminal 204, causes transistor 222 to turn on. Transistor 222 in turn drives transistor 224, which shifts the voltage level of the drive signal and provides drive to the base of transistor 206. Resistors 227 and 229 and diode 231, provide a small amount of negative feedback from the base of transistor 206 to transistor 222 to stabilize the drive circuit.

The current conducted by transistor 206 is limited by current limit circuitry to ensure that transistor 206 operates in its safe operating range. A portion of the collector current of transistor 206 is sensed by resistor 226, which has a low value of resistance and is preferably formed from a section of the collector metal of transistor 206. The voltage developed across resistor 226 provides a sense signal to the current limit circuit comprising transistors 228, 230, 232, 234, 236 and 238. Diode-connected transistor 228, which is connected to current source 223, provides a low A.C. impedance base drive to transistors 230 and 232. When no current is conducted by transistor 206, transistors 230 and 232 each conduct a current having a magnitude set by the values of their respective emitter resistors 240 and 242. Preferably, these resistors are equal, so that at zero output current transistors 230 and 232 conduct substantially equal current. The currents conducted by transistors 230 and 232 are provided to transistors 234 and 236. The current values are chosen such that transistor 234, which has an emitter area several times greater than that of diode-connected transistor 236, is normally saturated and holds transistor 238 off.

As the current conducted by transistor 206 increases, the voltage drop across resistor 226 increases proportionately. This causes the current conducted by transistor 232 to decrease. Current limiting begins when the ratio of currents conducted by transistors 230 and 232 equals the emitter area ratio of transistors 234 and 236. At this point, transistor 234 comes out of saturation and develops sufficient collector-emitter voltage to turn on transistor 238, which shunts drive current away from the base of transistor 222 and thereby limits the current conducted by transistor 206. The current conducted by transistor 238 is fed through resistor 244 to increase the gain of the current limit loop. Capacitor 246 provides frequency compensation to stabilize the loop.

Transistor 247, zener diode 248 and resistors 250, 252, 254, 256 and 244 form a foldback network which causes the current limit loop to limit the current conducted by transistor 206 at lower current values when the voltage differential between input and output terminals 202 and 204 increases above a threshold voltage. At input/output voltage differentials below the breakdown voltage of zener diode 248, no current is conducted by resistors 250, 252 and 254. Resistors 244 and 256 conduct only the current conducted by the emitter of transistor 234. Preferably, resistors 244 and 256 have low resistance values such that the voltage across the resistors is negligible at low input/output voltage differentials.

At input/output voltage differentials exceeding the breakdown voltage of zener diode 248, current is conducted by resistors 250, 252 and 254, and is fed through resistors 244 and 256, thereby raising the voltage across resistors 244 and 256. By adding voltage at the emitter of transistor 234, the current ratio needed to cause the circuit to current limit is reduced. As a consequence, current limit occurs at a lower current. The foldback network thus has a threshold voltage determined by the breakdown voltage of zener diode 248. The rate at which the current limit value decreases as the input/output voltage differential increases above the threshold voltage is set by the values of resistors 250, 252 and 254.

As the input/output voltage differential increases above the breakdown voltage of zener diode 248, the voltage across resistor 252 continues to increase until the base-emitter junction of transistor 247 becomes forward biased, and transistor 247 begins to conduct. At this point, the current fed to resistors 244 and 256 is effectively set by resistor 254 such that the current limit value is caused to decrease at a greater rate with increases in the input/output voltage differential. This breakpoint in the current limit is temperature sensitive. The voltage needed to forward bias the base-emitter junction of transistor 247 decreases at a rate of approximately 2 millivolts per degree centigrade. Thus, at high temperatures, where uncompensated temperature coefficients of various components in the regulator circuit cause the current limit value for a given input/output voltage differential to increase, the breakpoint in the current limit is made to occur at a lower input/output voltage differential to ensure that the transistor operates in its safe operating area.

Values for resistors 250, 252 and 254 and the breakdown voltage of zener diode 248 are chosen to define a safe operating range limit on the current-voltage characteristics of transistor 206. More particularly, because of the low ballast resistance of transistor 206, the values should be chosen to prevent transistor 206 from conducting at high input/output voltage differentials to protect transistor 206 against secondary breakdown.

While transistor 206 is thus disposed to conduct current at low input/output voltage differentials, transistor 208 is disposed to conduct current at higher input/output voltage differentials. At low input/output voltage differentials, control circuit 212 drives control point 210 to a voltage near the voltage at output terminal 204 to cause transistor 206 to conduct current between input and output terminals 202 and 204. At such low input/output voltage differentials, the voltage at the emitter of transistor 258, which conducts current provided by current source 260, is approximately one diode drop above the voltage at output terminal 204. This voltage is insufficient to turn on transistors 262 and 208. Thus, at those input/output voltage differentials for which transistor 206 is optimized to conduct load current, transistor 208 is held off.

When the input/output voltage differential reaches the threshold voltage at which the conduction of transistor 206 begins to limit, the voltage at terminal 204 will tend to decrease. Control circuit 212 senses this and responsively increases the voltage at control point 210 to compensate, such that when the voltage at control point 210 reaches a predetermined value sufficient turn on transistors 262 and 208, transistor 208 begins to conduct current between terminals 202 and 204. At this point the large ballast resistance of transistor 208 causes transistor 208 to saturate, thereby limiting the current conducted by transistor 208. Transistor 208 remains in saturation over a range of input/output voltage differentials above the threshold voltage at which current limiting of transistor 206 begins. Over this range, increases in the input/output voltage differential causes increases in the saturation current conducted by transistor 208.

As the input/output voltage differential increases beyond this range, and transistor 206 is in current limit, transistor 208 comes out of saturation and the current conducted by transistor 208 may increase until it is limited by the current limit circuitry described below. The ratio of currents conducted by transistors 206 and 208 thus varies as a function of the input/output voltage differential. At input/output voltage differentials sufficient to damage transistor 206 when transistor 206 conducts any substantial current, transistor 208 conducts substantially all of the current between input and output terminals 202 and 204.

Transistors 262 and 208 are connected as a Darlington pair to provide high current gain and buffering. Drive current is supplied to the Darlington pair by current source 260 and transistor 264. Transistor 264 has matched collectors, one connected to the base of transistor 264 and to the base of transistor 262, and the other connected to the collector of transistor 266. When base current is conducted by transistor 262, a voltage is dropped across resistor 268 connected between the bases of transistors 262 and 266. As the base current increases, transistor 266 is turned on and current is conducted by the collector-emitter circuits of transistors 264 and 266 and by resistor 270. The matched collector of transistor 264 conducts current to the base of transistor 262 which increases as a function of the base current conducted by transistor 262. Transistor 264 thus provides an increasing portion of the Darlington pair drive current as the load current conducted by transistor 208 increases. This releases current source 260 from the task of supplying the entire drive current required by the Darlington pair at higher load currents, thereby permitting the quiescent current conducted by current source 260 to be small, and reducing the variation in current conducted by transistor 258 as the load current varies.

The current conducted by transistor 208 is limited by a current limit circuit formed by transistors 272, 274 and 276. Diode-connected transistor 272 is connected to current source 278, and provides a bias point for the base of transistor 274. The emitter of transistor 272 is connected through resistor 280 to the voltage divider network formed by ballast resistors 213 and 217. As the current conducted by transistor 208 increases, the emitter voltage of transistor 272 increases, which in turn increases the base voltage of transistor 274. Current limit occurs when transistor 274 conducts sufficient current through resistor 282 to turn on transistor 276. During current limit, transistor 276 draws current away from the base of transistor 262, thereby limiting the current conducted by transistor 208. To compensate for the negative temperature coefficient of the base-emitter junction voltage of transistor 276, a voltage having a temperature coefficient of opposite polarity is developed across resistor 286. This voltage is created by the current conducted by current source 284, which has a positive temperature coefficient.

The current limit value, which is established by the value of ballast resistor 217, resistors 280, 282 and 286 and current source 284, is chosen empirically to ensure that transistor 208 operates in its safe operating area.

A foldback network formed by transistor 288, zener diode 290 and resistor 292, causes the current limit circuit to limit the current conducted by transistor 208 at lower current values when the input/output voltage differential exceeds a threshold value established in part by the breakdown voltage of zener diode 290. The current conducted by the foldback network for transistor 206 establishes a voltage at the base of transistor 288 which increases with the input/output voltage differential. When the increasing input/output voltage differential causes transistor 288 to turn on, transistor 288 conducts a current established by the value of resistor 292. This current is fed to the emitter of transistor 272 and causes the voltage of the emitter to increase, so that less voltage drop across ballast resistor 217 is required to cause current limiting. Preferably, values for resistor 292 and the breakdown voltage of zener diode 290 are chosen to prevent transistor 208 from conducting at very high input/output voltage differentials to protect transistor 208 against damage resulting from secondary breakdown.

The circuit further includes resistance components to conduct leakage currents. Pull-up resistor 225 prevents leakage currents from causing transistor 224 to conduct current after transistor 224 has been turned off. Likewise, pull-down resistor 294 ensures that transistor 208 is not turned on by leakage currents after it has been turned off.

The values of the components in the preferred embodiment of the regulator circuit of FIG. 2 are as follows:

| COMPONENT | VALUE |
|---|---|
| ballast resistor 211 | 1.1 ohms |
| ballast resistor 213 | 50 ohms |
| ballast resistor 217 | 1.7 ohms |
| current source 220 | 200 microamps |
| current source 223 | 100 microamps |
| resistor 225 | 1K ohms |
| resistor 226 | 0.14 ohms |
| resistor 227 | 50 ohms |
| resistor 229 | 10 ohms |
| resistor 240 | 3K ohms |
| resistor 242 | 3K ohms |
| resistor 244 | 10 ohms |
| capacitor 246 | 70 pf |
| zener diode 248 | 7 volts (breakdown voltage) |
| resistor 250 | 16K ohms |
| resistor 252 | 1.8K ohms |
| resistor 254 | 10K ohms |
| resistor 256 | 90 ohms |
| current source 260 | 200 microamps |
| resistor 268 | 500 ohms |
| resistor 270 | 500 ohms |
| current source 278 | 200 microamps |
| resistor 280 | 200 ohms |
| resistor 282 | 3K ohms |
| current source 284 | 200 microamps |
| resistor 286 | 1K ohms |
| zener diode 290 | 7 volts (breakdown voltage) |
| resistor 292 | 10.6K ohms |
| resistor 294 | 1K ohms |

As the circuit of FIG. 2 has been described above, and as will be described below in connection with FIG. 3, transistors 206 and 208 conduct substantial load current simultaneously over a range of input/output voltage differentials (approximately 3–20 volts) only when transistor 206 is in current limit. When transistor 206 is not current limit at voltage differentials in that range, transistor 208 does not conduct. At voltage differentials below that range, only transistor 206 conducts substantial load current, and at voltage differentials above that range, only transistor 208 conducts substantial load current. It will of course be appreciated by those of skill in the art that the circuit can be configured so that in a first range of input/output voltage differentials (e.g., 1–20 volts), both transistors are simultaneously conducting, but in a range of higher voltage differentials only one transistor conducts. Alternatively, the circuit can be configured so that one transistor conducts in a first range (e.g. 1–20 volts), and the other conducts in a second range (e.g., 20–40 volts), such that there is no substantial overlap between the first and second ranges.

Figure 3:
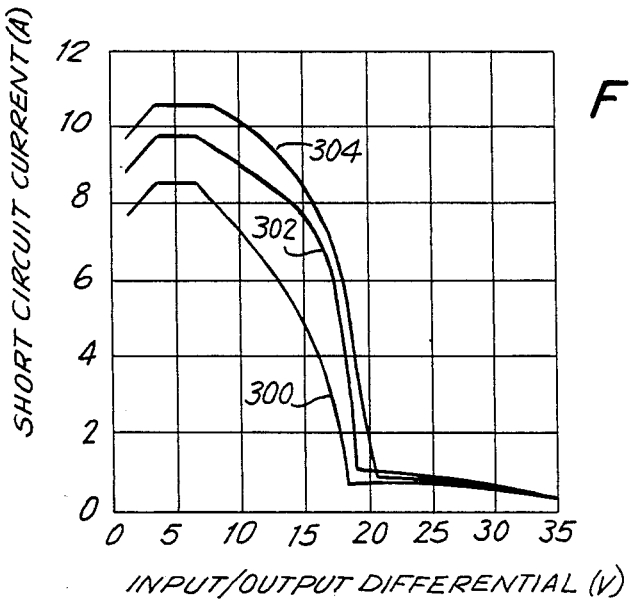
FIG. 3 is a graph showing the operation of the regulator circuit of FIG. 2.

FIG. 3 shows how the regulator circuit of FIG. 2 operates at three operating temperatures. Curves 300, 302 and 304 represent respectively the output of regulator circuit 100 at temperatures of −55° C., 25° C. and 150° C. when a power supply is connected to input terminal 202 and output terminal 204 is short-circuited to ground. At input/output voltage differentials of less than 3 volts, output current is conducted by transistor 206. At voltage differentials above 3 volts, transistor 208 conducts current when transistor 206 is limiting. At voltage differentials between approximately 3 volts and 20 volts, the current conducted by transistor 208 is limited to approximately one amp, the remainder of the output current being conducted by transistor 206. At higher voltage differentials, transistor 206 is limited to an extremely low current and substantially all of the current is conducted by transistor 208. At voltage differentials exceeding approximately 40 volts, transistor 208 is turned off to prevent damage. FIG. 3 illustrates that the present invention enables a voltage regulator circuit or power switch having a low saturation voltage to supply an output current when a large supply voltage is applied and the output is effectively shorted to ground by the load.

Thus, a novel circuit for distributing load current among multiple power transistors, each adapted to conduct current optimally over a different range of collector-emitter voltages, has been described. Although a preferred embodiment of the invention has been disclosed with various components connected to other components, one skilled in the art will appreciate that additional components may be interconnected between the shown connected components without departing from the spirit of the invention as shown. Further, component and other values and parameters may be modified. One skilled in the art will appreciate also that the present invention can be practiced by other than the described embodiment, and in particular may be incorporated in circuits other than the described voltage regulator circuit, and may be modified for use with any number of bipolar or MOS power transistors. The described embodiment is presented for purposes of illustration and not of limitation, and the present invention is limited only by the claims which follow.

What is claimed is:

1. A circuit for conducting current between an input terminal and an output terminal in response to a control signal, said circuit comprising:

at least first and second transistors, each adapted to conduct a current between said input and output terminals; and means connected to said first and second transistors for individually adjusting the current conducted by each of said first and second transistors as a function of the voltage differential between said input and output terminals, whereby said first and second transistors conduct current between said input and output terminals over different ranges of voltage differentials.

2. The circuit of claim 1, wherein said control signal is applied to a single control point for said first and second transistors.

3. The circuit of claim 1, wherein said means for individually adjusting the current conducted by said first and second transistors comprises:

a resistance connected between the emitter of said first transistor and said output terminal, as a result of which said first transistor is prevented from conducting substantial current between said input and output terminals over a first range of voltage differentials; and means connected to the base of said second transistor for limiting drive current provided to the base of said second transistor to prevent said second transistor from conducting substantial current over a second range of voltage differentials, whereby said first transistor conducts current between said input and output terminals over said second range of voltage differentials, and said second transistor conducts current between said input and output terminals over said first range of voltage differentials.

4. The circuit of claim 3, wherein said first transistor operates in saturation over said first range of voltage differentials.

5. The circuit of claim 1, wherein said means for individually adjusting the current conducted by said first and second transistors comprises:

means connected to the base of said first transistor for limiting drive current provided to the base of said first transistor to limit the current conducted by said first transistor; and means connected to the base of said second transistor for providing drive current to the base of said second transistor when said drive current limiting means limits the drive current provided to said first transistor, whereby said first and second transistors conduct current between said input and output terminals simultaneously over a range of voltage differentials.

6. The circuit of claim 4 or claim 5, wherein said input and output terminals comprise respectively the input and output terminals of a 3-terminal voltage regulator.

7. A circuit for conducting current between an input and an output terminal in response to a control signal, said circuit comprising:

at least first and second transistors, each adapted to conduct current between said input and output terminals, said first transistor adapted to conduct high current at low collector-emitter voltages, and said second transistor adapted to conduct high current at high collector-emitter voltages; and means for varying the current conducted by each of said first and second transistors, whereby, substantially all of the current conducted between said input and output terminals is conducted by said first transistor over a first range of voltage differentials between said input and output terminals, and substantially all of the current conducted between said input and output terminals is conducted by said second transistor over a second range of voltage differentials between said input and output terminals, said second range being higher than the first range.

8. The circuit of claim 7, further comprising first and second ballast resistances connected to said first and second transistors, wherein said first ballast resistance is less than said second ballast resistance.

9. A circuit for conducting a load current between an input terminal and an output terminal in response to a control signal, said circuit comprising:

first and second transistors, each having a ballast resistance and each adapted to conduct a current between said input and output terminals, said first transistor having a ballast resistance which is greater than the ballast resistance of said second transistor;

third and fourth transistors having a common base drive node adapted to receive said control signal;

means connected to an emitter of said third transistor at a first node and to the base of said first power transistor for providing drive current to the base of said first transistor in response to said control signal when said control signal exceeds a predetermined value;

means connected to an emitter of said fourth transistor at a second node and to the base of said second transistor for providing drive current to the base of said second transistor in response to said control signal;

means connected to said first and second nodes for limiting the current conducted by said first and second transistors, whereby said first transistor conducts substantially all of said load current over said first range of voltage differentials and second transistor conducts substantially all of said load current over said second range of voltage differentials.

* * * * *